US005142326A

United States Patent [19]

Iwata et al.

[11] Patent Number: 5,142,326

[45] Date of Patent: Aug. 25, 1992

[54] IMAGE FORMING APPARATUS ELIMINATING IMAGE OF DOCUMENT COVER

[75] Inventors: Yasuhiro Iwata; Koji Kubo, both of Yokohama, Japan

[73] Assignee: Kabushiki Kaisha Toshiba, Kawasaki, Japan

[21] Appl. No.: 615,060

[22] Filed: Nov. 19, 1990

[30] Foreign Application Priority Data

Nov. 20, 1989 [JP] Japan ..... 1-301603

[51] Int. Cl.[5] ..... G03G 15/02; G03G 15/04; G03G 15/06

[52] U.S. Cl. ..... 355/208; 355/75; 355/228; 355/246; 355/219

[58] Field of Search ..... 355/246, 208, 219, 228, 355/232, 75

[56] References Cited

U.S. PATENT DOCUMENTS 4,474,453 10/1984 Yanagawa et al. .
4,505,575 9/1985 Palumbo .
4,544,263 10/1985 Sasaki et al. .
4,666,144 5/1987 Silverberg ..... 271/270
4,857,958 8/1989 Osawa et al. ..... 355/218
4,965,634 10/1990 Bando ..... 355/208
5,005,049 4/1991 Matsushita ..... 355/208

FOREIGN PATENT DOCUMENTS 2-100063 4/1990 Japan .
2-100067 4/1990 Japan .
2-100068 4/1990 Japan .
2-100071 4/1990 Japan .
2-100072 4/1990 Japan .

OTHER PUBLICATIONS

Patent Abstracts of Japan, vol. 7, No. 2 (P-166), Jan. 7, 1983.
Patent Abstracts of Japan, vol. 9, No. 141 (P-364), Jun. 15, 1985.

*Primary Examiner*—Richard L. Moses
*Attorney, Agent, or Firm*—Foley & Lardner

[57] ABSTRACT

When an original is carried onto a support by a carrier in accordance with a depression of a copy key a density of an image formed on a transferred medium is decreased. Formation of an unwanted image caused by an opening portion of a covering can be prevented, and a good image can be formed.

17 Claims, 8 Drawing Sheets

IMAGE FORMING APPARATUS ELIMINATING IMAGE OF DOCUMENT COVER

BACKGROUND OF THE INVENTION

1. Field of the Invention

The present invention relates to an image forming apparatus for recording an image corresponding to an original image on a recording medium.

2. Description of the Related Art

An automatic original feeder is arranged in an image forming apparatus such as an electronic copying apparatus to automatically feed an original to an original table or to feed it from the original table. An opening portion is formed in, e.g., an original table cover in the automatic original feeder. A carrying roller for carrying an original is arranged on the table in the location corresponding to the opening portion. When an original is to be copied by an electronic copying apparatus having the automatic original feeder, an original fed to the original table in the automatic original feeder is exposed and scanned by an exposure/scanning unit while the original is kept in contact with the original table by means of the original table cover.

When a thin original is to be copied by the electronic copying apparatus having the automatic original feeder, light emitted from the exposure/scanning unit is reflected by the original and is also transmitted through it and reflected by the original table cover. These light components reflected by the original and the original table cover are radiated on a photosensitive drum through an optical system. Since a contact surface of the original table cover is white or has a light color, a portion in contact with the original table cover is copied to accurately reproduce an original image because an electric charge of the corresponding portion of the photosensitive drum is removed by the light reflected by the original table cover.

A portion corresponding to the opening portion of the original table cover has a small amount of reflected light because light emitted from the exposure/scanning unit and transmitted through the original is attenuated, and the electric charge of the photosensitive drum is not sufficiently removed. Therefore, an unwanted image, corresponding to the opening portion of the original cover is formed in the copied image, thus posing a serious problem.

SUMMARY OF THE INVENTION

It is an object of the present invention to overcome the problem of the conventional image forming apparatus and to provide an image forming apparatus capable of preventing formation of an unwanted image, corresponding to an opening portion of an original table cover.

In order to achieve the above object of the present invention, there is provided an image forming apparatus for causing exposing/scanning means to expose and scan an image of an original and for forming an image corresponding to the image of the original on a transferred medium, comprising: means for supporting an original, means for carrying the original onto the supporting means, means having an opening portion to store the carrying means, for covering the supporting means, means for designating a carrying operation of the original by the carrying means, and means for correcting a density of the image formed on the transferred medium in correspondence with the opening portion when the original is fed onto the supporting means in accordance with a designation of the designating means.

According to the present invention, when the original is fed onto the supporting mean by the carrying means in accordance with the designation of the designating means, the density of the image to be formed on the transferred means is corrected by the correcting means, and an unwanted image, caused by the opening portion of the covering means, is prevented, thereby obtaining a good image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An embodiment of an image forming apparatus of the present invention will be described hereinafter with reference to the accompanying drawings.

Figure 1:
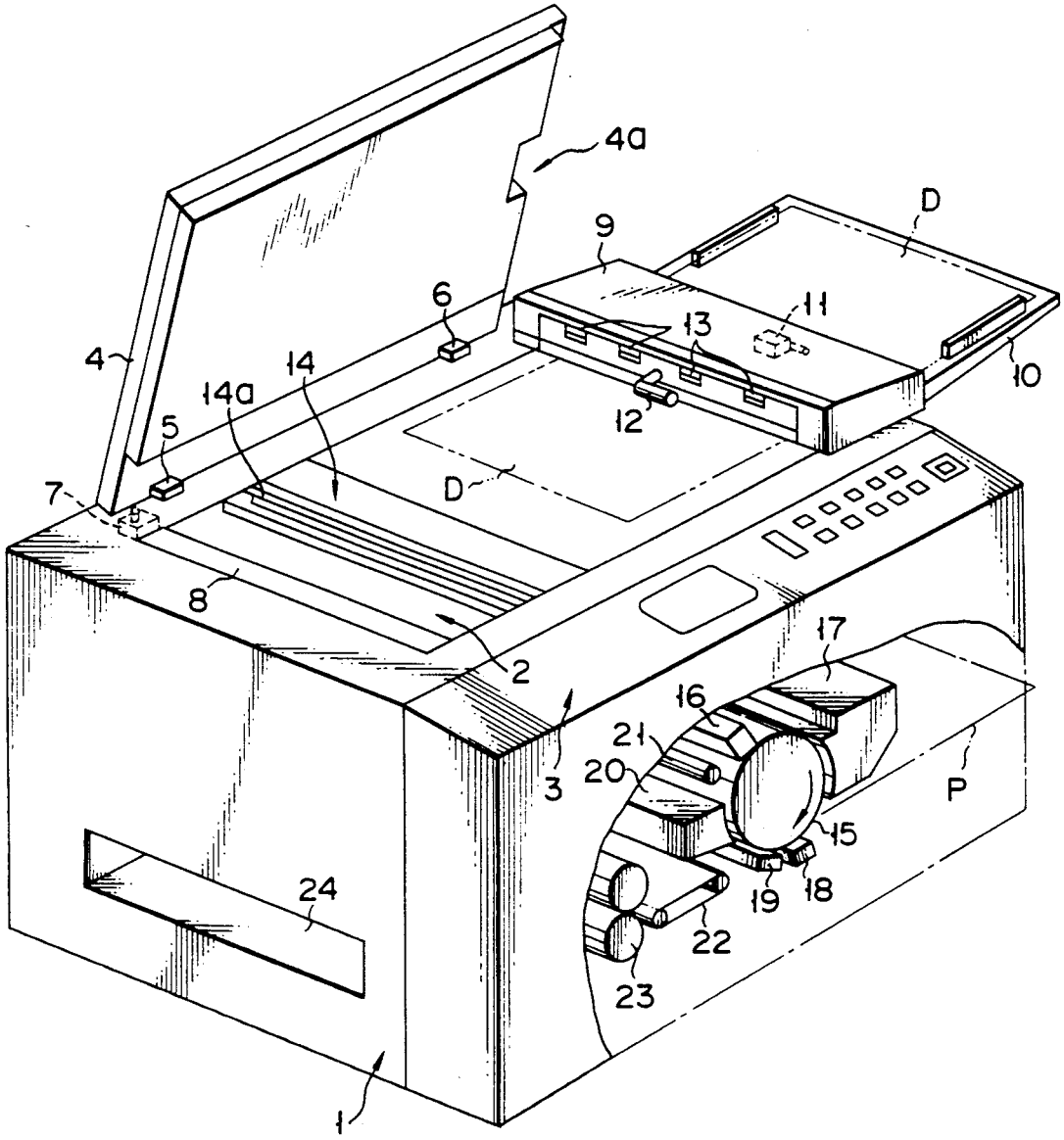
FIG. 1 is a partially cutaway perspective view showing an embodiment of an image forming apparatus according to the present invention.

FIG. 1 is a perspective view showing an embodiment of the image forming apparatus according to the present invention. An original table 2 is arranged in an upper surface portion of a main body 1 of an electronic copying apparatus. An operation panel 3 for setting the number of the copies, various operation modes and the like is arranged in front of the original table 2. An original table cover 4 which can be opened and closed, for covering the original table 2 is arranged in the rear portion of the original table 2. The original table cover 4 is used to bring an original into tight contact with the original table 2 during a copying operation of the original. The surface of the original table cover 4 which is brought into contact with the original table 2 is white or has a light color. When a thick original such as a book is set on the original table 2, hinge portions 5 and 6 of the original table cover 4 can be vertically moved in accordance with the thickness of the original. An opening/-closing detecting switch 7 is arranged inside the main body 1 to detect opening/closing of the original table cover 4.

A scale 8 serving as a reference for manually setting an original is provided at one end portion of the original table 2 along its longitudinal direction. An automatic original feeder 9 is arranged at the other end portion of the original table 2 along its longitudinal direction. The automatic original feeder 9 comprises a pickup roller (not shown) for picking up each original D set on an original tray 10 provided on the main body 1 and feeding it onto the original table 2, an original detecting switch 11, a carrying roller 12, and a plurality of discharging rollers 13.

The original detecting switch 11 detects the presence/absence of an original on the original tray 10. The carrying roller 12 sets each original picked up from the original tray 10 by the pickup roller with reference to the other end portion of the original table 2 along its longitudinal direction, as shown in FIG. 1. In addition, upon completion of the copying operation of the original, the carrying roller 12 removes the original from the original table 2 and feeds it to the automatic original feeder 9. The plurality of discharging rollers 13 discharge the original fed by the carrying roller 12 into the automatic original feeder 9 onto the upper surface of the original table cover 4 which covers the original table 2 upon completion of the copying operation. An opening portion 4*a* is formed in the original table cover 4. When the original table cover 4 is kept closed, the carrying roller 12 is fitted in the opening portion 4*a*.

An exposure/scanning unit 14 having an exposure lamp 14*a* is arranged inside the main body 1. The exposure/scanning unit 14 radiates light emitted from the exposure lamp 14*a* onto the original and exposes and scans the original. A photosensitive drum 15 is arranged near the exposure/scanning unit 14. A charger 16, a developer 17, a transferring charger 18, a separating charger 19, a cleaner 20, and a discharge lamp 21 are arranged around the photosensitive drum 15 along the direction of its rotation.

The charger 16 applies a predetermined charge to the photosensitive drum 15. The developer 17 applies a toner to an electrostatic latent image formed on the surface of the photosensitive drum 15 upon exposure and scanning of the original, thereby forming a toner image. The transferring charger 18 transfers the toner image developed by the developer 17 onto a copy sheet P carried by the carrying means (not shown). The separating charger 19 separates the copy sheet P from the photosensitive drum 15. Upon completion of a separation, the cleaner 20 removes toner particles left on the surface of the photosensitive drum 15. The discharge lamp 21 discharges a residual charge from the photosensitive drum 15.

The copy sheet separated from the photosensitive drum 15 by the separating charger 19 is carried to a fixing unit 23 along a carrying belt 22. After the toner image is fixed on the copy sheet by the fixing unit 23, the copy sheet is discharged outside the main body 1 from a discharging port 24.

Figure 2:
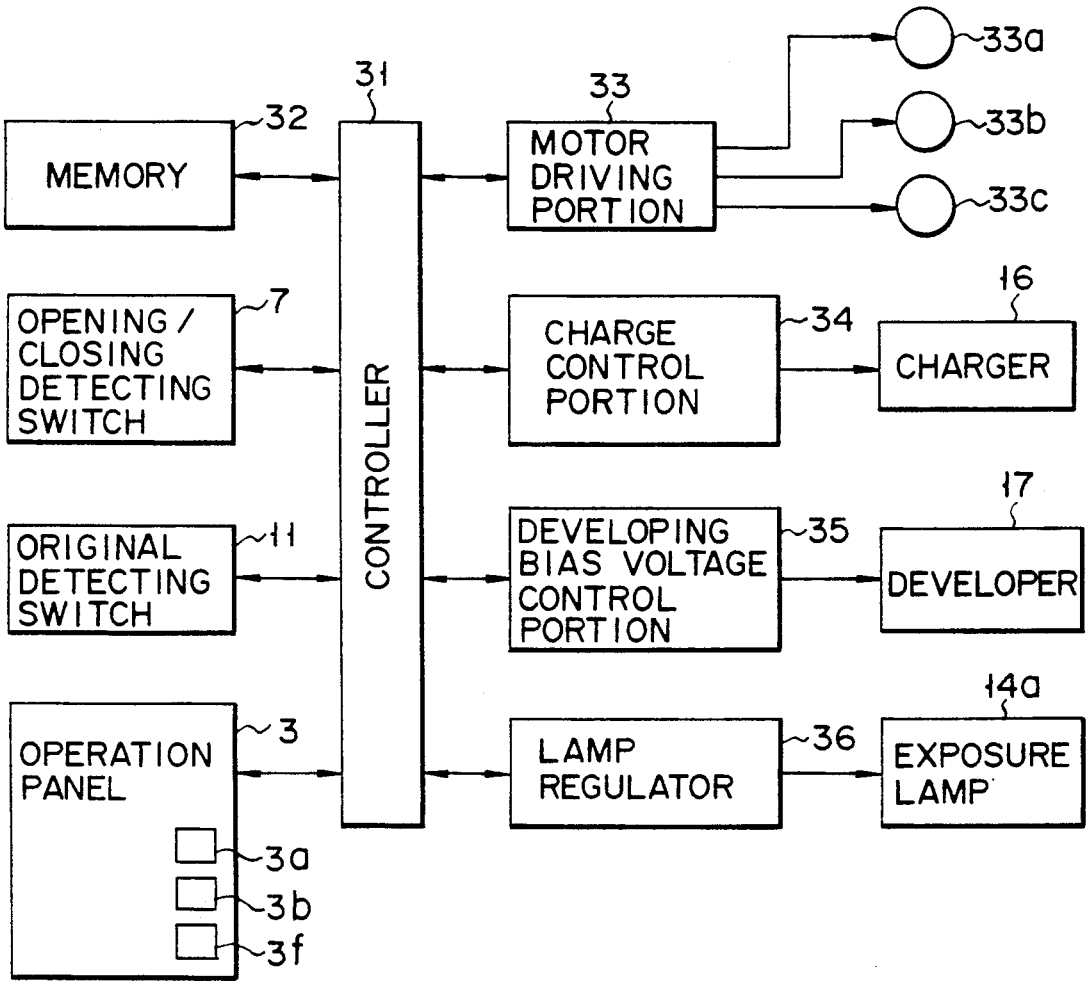
FIG. 2 is a block diagram showing an arrangement of a control system of the image forming apparatus shown in FIG. 1.

FIG. 2 is a block diagram showing an arrangement of a control system in the image forming apparatus shown in FIG. 1. A controller 31 comprises, e.g., a microcomputer and controls the operations of the overall electronic copying apparatus. The controller 31 is connected to a memory 32, various switches (e.g., the opening/closing detecting switch 7 and the original detecting switch 11), the operation panel 3, a motor driving portion 33, a charge control portion 34, a developing bias voltage control portion 35, and a lamp regulator 36. The memory 32 stores programs for controlling the operations of the controller 31 and a correction value for an exposure amount (to be described later). The motor driving portion 33 drives a motor 33*a* for driving the exposure/scanning unit 14 arranged inside the main body 1, a motor 33*b* for driving the photosensitive drum 15, and a motor 33*c* for driving a carrying system for carrying the copy sheet as a transferred medium. The charge control portion 34 controls the charger 16. The charge control portion 34 controls an ON/OFF operation of the charger 16 and a charge amount of the photosensitive drum 15. The developing bias voltage control portion 35 controls a bias voltage applied to a developing roller (not shown) arranged in the developer 17 and controls an amount of toner supplied to the photosensitive drum 15. The lamp regulator 36 controls the ON operation and light amount, i.e., an exposure amount of the original, of the exposure lamp 14*a* arranged in the exposure/scanning unit 14.

Figure 3:
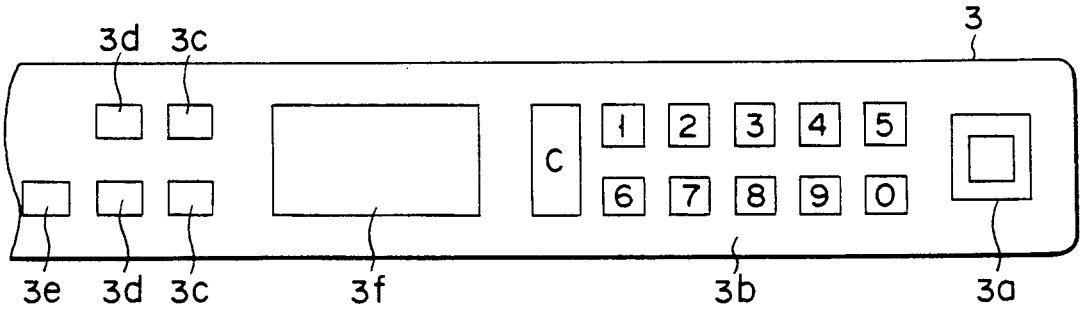
FIG. 3 is a plan view showing a main part of an operation panel 3 in FIG. 1.

FIG. 3 is a plan view showing the main part of the operation panel 3 in FIG. 1. The operation panel 3 includes a copy key 3*a* for designating a start of the copying operation, a ten-key pad 3*b* for setting the number of copies, various modes such as a correction amount change mode (to be described later), a magnification key 3*c* for setting a copying magnification, a copying density key 3*d* for setting a copying density, a correction mode key 3*e* for setting an image density correction mode (to be described later), and a display portion 3*f* for displaying information corresponding to each key input operation and paper jam.

A first embodiment of the image forming apparatus of the present invention will be described below.

Figure 4A:
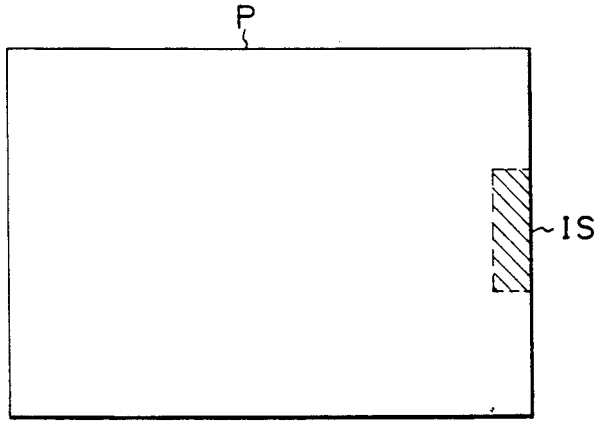
FIG. 4A is a plan view showing an unwanted image IS on a copy sheet.
Figure 4B:
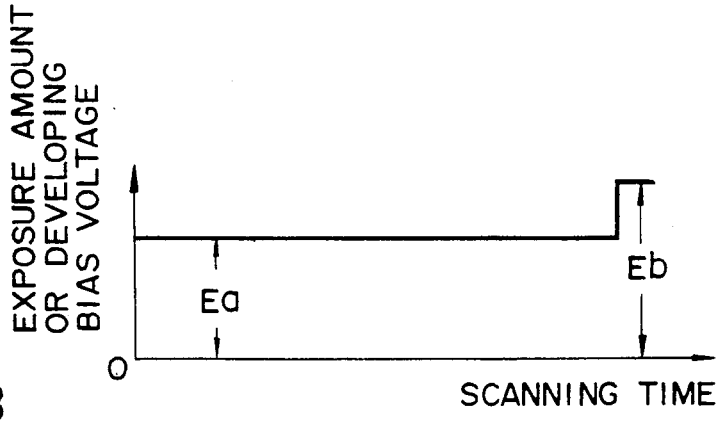
FIG. 4B is a graph explaining a correction value for an exposure amount or a developing bias voltage of the unwanted image IS according to a first or second embodiment of the present invention.

FIG. 4A is a plan view showing an unwanted image IS on the copy sheet, and FIG. 4B is a graph explaining a correction value for an exposure amount or a developing bias voltage of the unwanted image IS in the first or second embodiment of the present invention. As shown in FIG. 4A, when the unwanted image IS is formed on the copy sheet P, a reference exposure amount Ea corresponding to an image except for the unwanted image IS is set, and an exposure amount Eb larger than the reference value is set as a correction value in correspondence with the unnecessary image IS. The exposure amount Eb is set in correspondence with an amount of light reflected from the opening portion 4*a*. The exposure amounts Ea and Eb are stored in the memory 32.

When the copying portion is started, the exposure amounts Ea and Eb are read out from the memory 32 upon movement of the exposure/scanning unit 14. Since the position of the opening portion 4*a* of the original table cover 4 is fixed in the copying apparatus, the exposure amounts Ea and Eb are read out in accordance with the position of the opening portion 4*a*. More specifically, when the exposure/scanning unit 14 scans an original portion except for the opening portion 4*a*, the exposure amount Ea is read out. However, when the exposure/scanning unit 14 scans an original portion corresponding to the opening portion 4*a*, the exposure amount Eb is read out. In the first embodiment, the exposure amount of the exposure lamp 14*a* is therefore corrected.

Operations of the image forming apparatus of this embodiment will be described hereinafter with reference to FIGS. 5A and 5B.

Figure 5A:
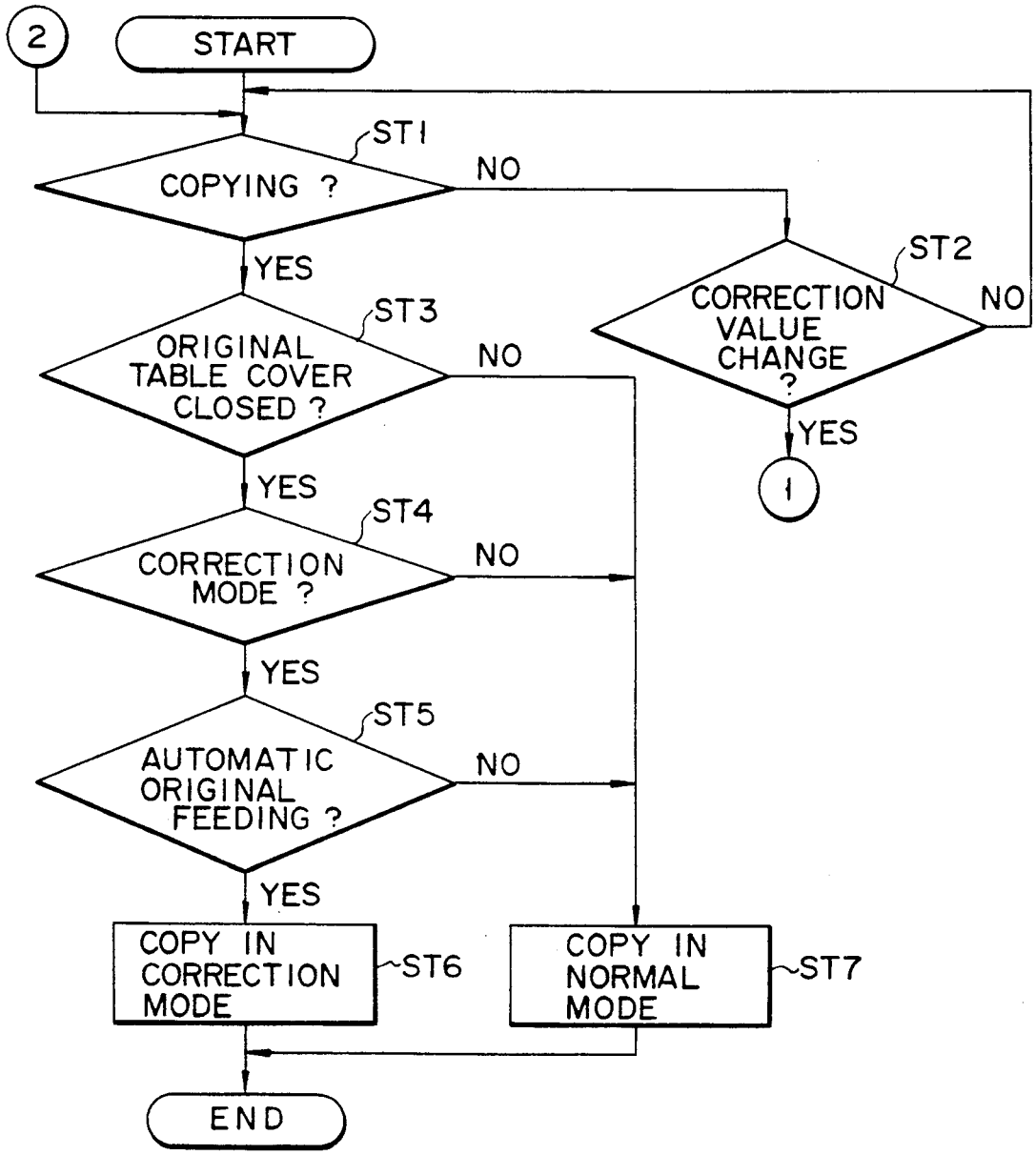
FIGS. 5A and 5B are flow charts explaining a copying operation of the image forming apparatus when taken together.
Figure 5B:
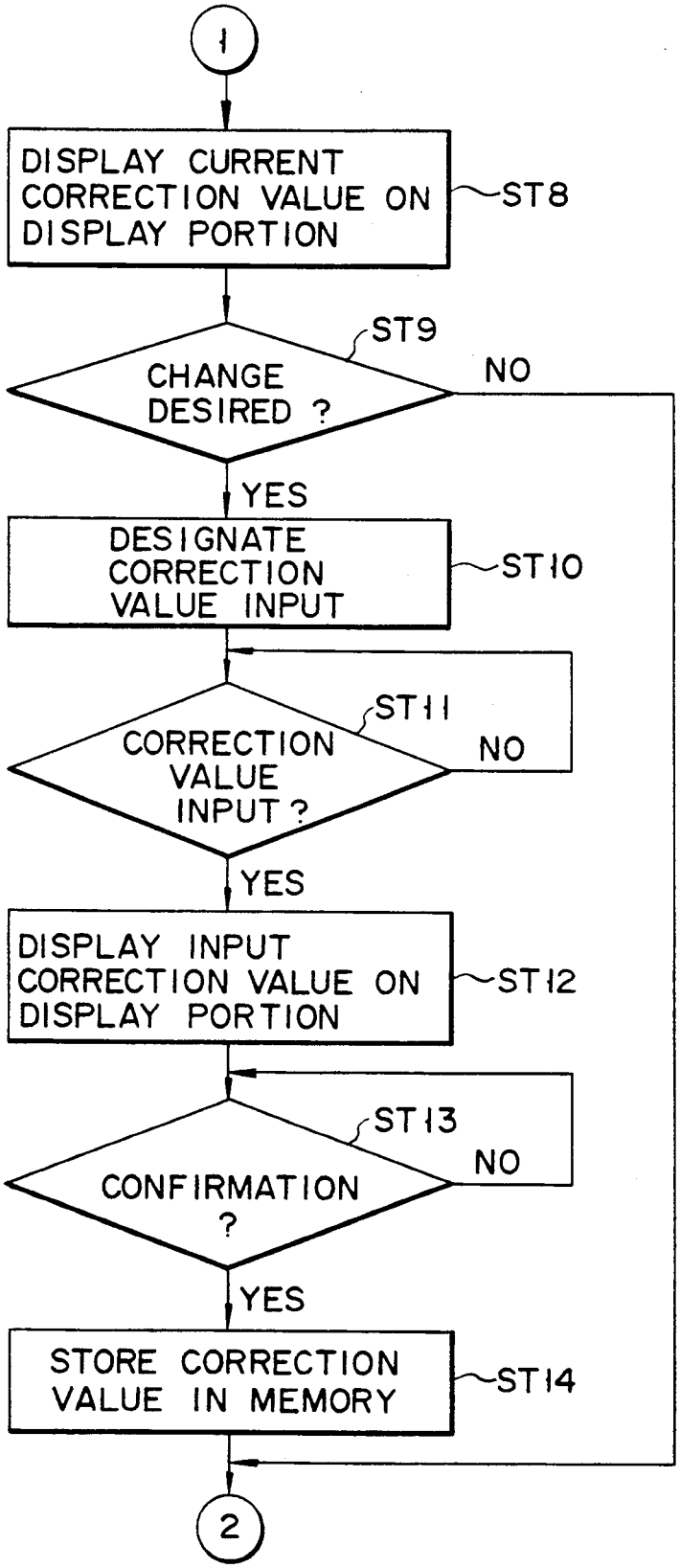

FIGS. 5A and 5B are flow charts explaining the copy operation of the image forming apparatus. Referring to FIG. 5A, the controller 31 determines whether the copy key 3*a* in the operation panel 3 is depressed (step ST1). If NO in the step ST1, the controller 31 determines whether a correction value change mode is set (step ST2). This correction value change mode can be set upon simultaneous depression of, e.g., "0" and "1" keys constituting the ten-key pad 3*b* on the operation panel 3. If NO in the step ST2, the flow returns to the step ST1.

If YES in the step ST1, i.e., if the controller 31 determines that the copy key 3*a* is depressed, the controller 31 detects an operating state of the opening/closing detecting switch 7 (step ST3). If the controller 31 determines that the opening/closing detecting switch 7 is ON and that the original table cover 4 is kept closed, the controller 31 determines whether the correction mode key 3*e* on the operation panel 3 is operated to set the image density correction mode (step ST4). If YES in the step ST4, the controller 31 determines whether the original detecting switch 11 of the automatic original feeder 9 is ON, i.e., whether an original is set on the original tray 10 (step ST5). As a result, when the controller 31 determines that the original is set on the original tray 10, the copying operation is performed in the image density correction mode (step ST6).

More specifically, each original is picked up from the original tray 10 by the automatic original feeder 9 and is set on the original table 2, as shown in FIG. 1. In this state, the exposure/scanning unit 14 is moved along the original. Upon movement of the exposure/scanning unit 14, the correction values are sequentially read out from the memory 32. The exposure lamp 14*a* is turned on by the lamp regulator 36 in accordance with the readout correction values. That is, the original portion except for the opening portion 4*a* of the original table cover 4 is exposed with the reference exposure amount Ea, and the original portion, corresponding to the opening portion 4*a* is exposed with the exposure amount Eb larger than the reference exposure amount Ea. An amount of light reflected from the opening portion 4*a* is set to be almost equal to that from the portion except for the opening portion 4*a*, and an unwanted latent image corresponding to the opening portion 4*a*of the original cover 4 is not formed on the photosensitive drum 15. Therefore, when the latent image is transferred to the copy sheet, the unnecessary image is not formed on the copy sheet.

If the controller 31 determines in the step ST3 that the original cover 4 is open, if the controller 31 determines in the step ST4 that the image density correction mode is not set, and if the controller 31 determines in the step ST5 that the original is not set on the original tray 10, the correction stored in the memory 32 are not used, and a normal copying operation is performed (step ST7).

Figure 6:
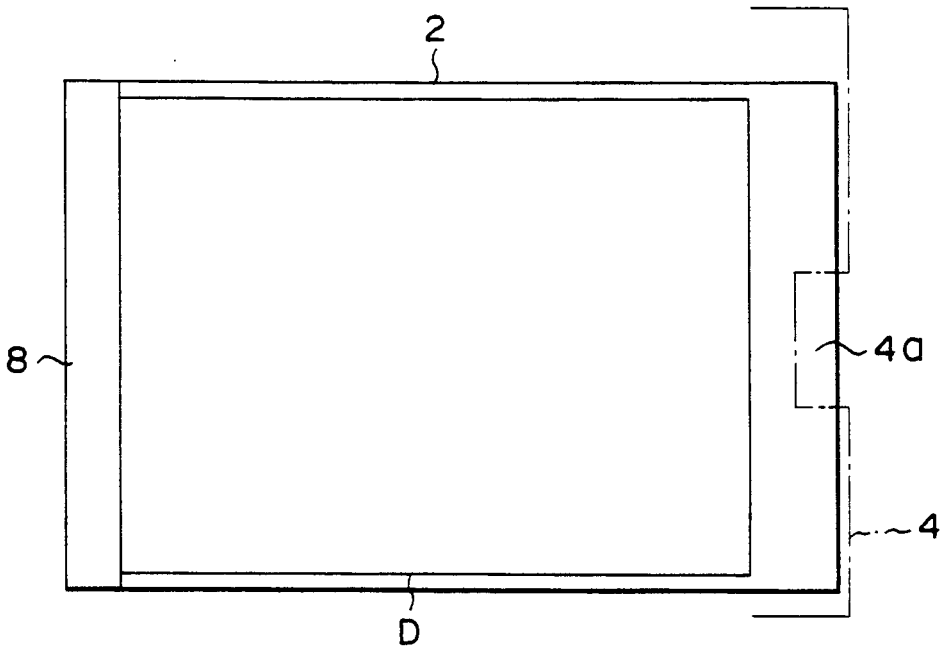
FIG. 6 is a plan view showing a positional relationship between a set position of an original and an opening portion.

When the controller 31 determines in step ST3 that the original cover 4 is open, a thick original is set on the original table 2, and no correction is required. When the controller 31 determines in the step ST4 that the image density correction mode is not set, processing is performed in the currently set mode. When the controller 31 determines in the step ST5 that the original is not set on the original tray 10, the original is manually set. When the original is manually set, the original is set along the scale 8 on the original table 2, as shown in FIG. 6. Since the size of the original table 2 is larger than a maximum size of the original, even if the original having a maximum size is set, the end of the original does not close the opening portion 4*a* of the original cover 4. Therefore, no correction is required.

An operation in the correction amount change mode set in the step ST2 will be described with reference to FIG. 5B. A current correction value stored in the memory 32 is read out, and the readout correction value is displayed on the display portion 3*f* on the operation panel 3 (step ST8). In this state, the controller 31 determines whether a key for changing a desired correction value, e.g., a "clear key C" is operated (step ST9). If NO in the step ST9, the flow returns to the step ST1 in FIG. 5A. However, if YES in the step ST9, a message for instructing an operator to input a correction value is displayed on the display portion 3*f* (step ST10). Thereafter, when a correction value is input with the ten-key pad 3*b* (step ST11), the input correction value is displayed on the display portion 3*f* (step ST12). When the "clear key C" which represents confirmation of key depression is operated (step ST13), the input correction value is stored in the memory 32 (step ST14), and the normal mode is restored (step ST1).

According to the first embodiment, since the exposure amount of the exposure lamp 14*a* is set to be large in correspondence with the opening portion 4*a* of the original table cover 4, even if a thin original is to be copied, an unwanted image formed in correspondence with the opening portion 4*a* can be eliminated. When the opening/closing detecting switch 7 detects that the original table cover 4 is kept open, the exposure amount is not corrected. When a thick original is to be copied, an original image corresponding to the opening portion 4*a* of the original table cover 4 will not have a low density. When an original is manually set on the original table 2, when the correction mode is not set with the correction mode key 3*e*, or when the automatic original feeder 9 is not used, the exposure amount is not corrected. Therefore, wasteful operations can be eliminated. In addition, when the correction value change mode is designated from the operation panel 3, the exposure amount of the exposure lamp can be changed, so that an optimal exposure amount corresponding to an amount of light from the opening portion 4*a* can be set.

A second embodiment of the image forming apparatus of the present invention will be described below.

The correction value of the exposure amount of the exposure lamp 14*a* is corrected in the first embodiment. In the second embodiment, however, a developing bias voltage of the developer 17 shown in FIG. 2 is changed in accordance with a correction value to obtain the same effect as described above. In this case, the developing bias voltage corresponding to the opening portion 4*a* of the original table cover 4 is set to be higher than the developing bias voltage corresponding to the portion except for the opening portion 4*a*.

The same effect as in the first embodiment can be obtained in this arrangement of the second embodiment.

A third embodiment of the image forming apparatus of the present invention will be described below.

Figure 7:
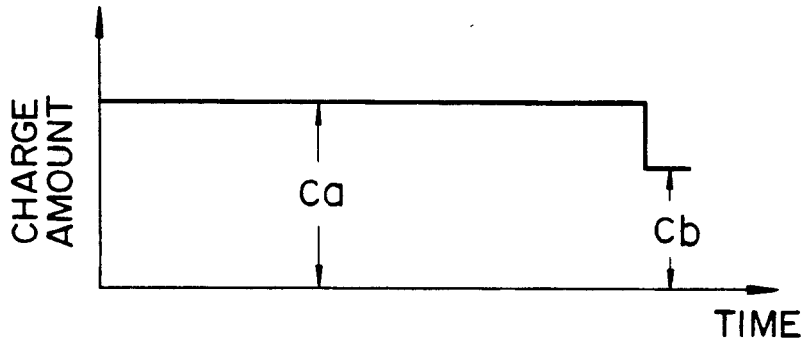
FIG. 7 is a graph explaining a correction value for a charge amount of an unwanted image IS according to a third embodiment of the image forming apparatus of the present invention.

The unwanted image IS corresponding to the opening portion 4*a* of the original table cover 4 can be eliminated by changing a charge amount of the photosensitive drum 15 by means of the charger 16. In this case, as shown in FIG. 7, a charge amount Cb of the portion corresponding to the opening portion 4*a* is set to be smaller than a charge amount Ca of the portion except for the opening portion 4*a* , and these amounts are stored in the memory 32 as correction values.

With this arrangement, when the latent image formed on the photosensitive drum is to be developed by the developer, an amount of toner attached to the portion corresponding to the opening portion 4*a* can be reduced, and formation of the unwanted image IS can be prevented.

A fourth embodiment of the image forming apparatus of the present invention will be described with reference to FIGS. 8 and 9. The same reference numerals as in FIG. 1 denote the same parts in FIG. 8, and only different parts will be described below.

Figure 8:
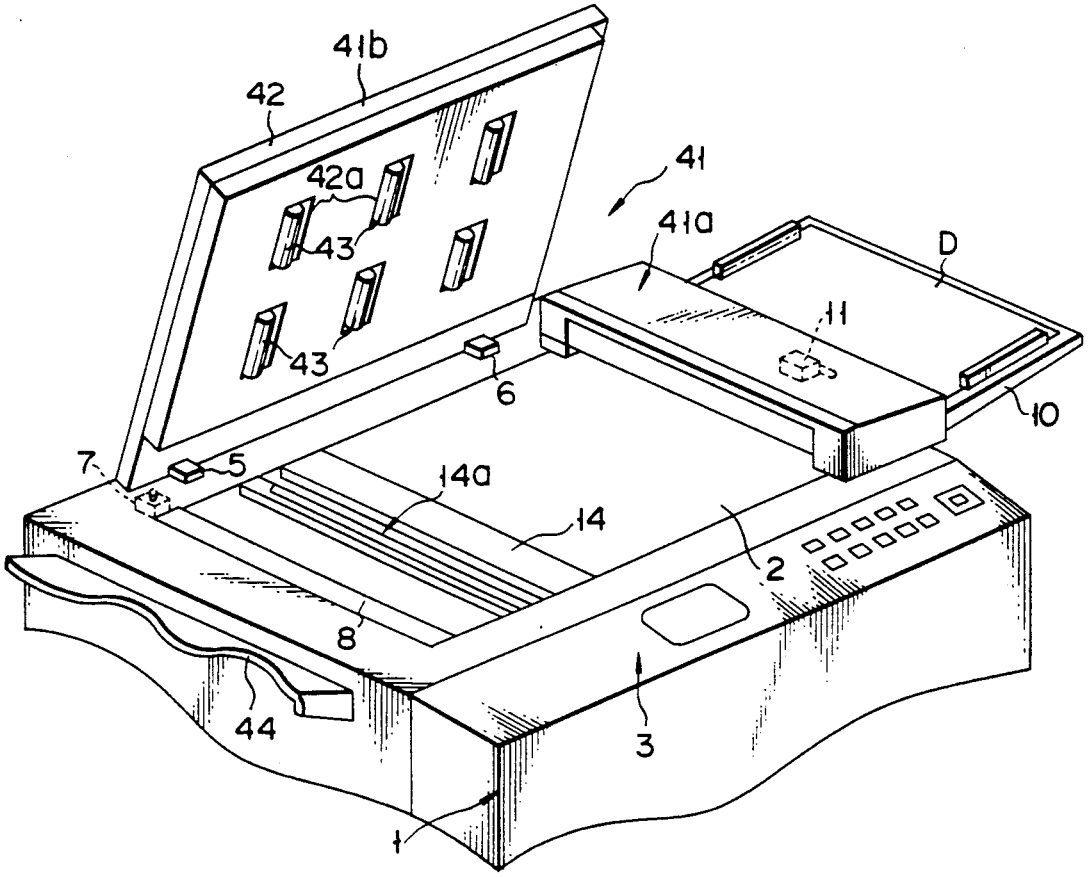
FIG. 8 is a perspective view showing a main part according to a fourth embodiment of the image forming apparatus of the present invention.

The image forming apparatus according to the fourth embodiment of the present invention shown in FIG. 8 has an automatic original feeder different from that in FIG. 1. An automatic original feeder 41 comprises a pickup unit 41*a* and a carrying unit 41*b*. The pickup unit 41*a* carries the original D picked up from the original tray 10 and carries it to the original table 2. The original D carried on the original table 2 is carried to one end of the original table 2 along its longitudinal direction by the carrying unit 41*b*. The carrying unit 41*b* comprise a plurality of carrying rollers 43 arranged on a surface of an original table cover 42 which opposes the original table 2. The carrying rollers 43 are stored in an opening portion 42*a* formed in the original table cover 42. The original D carried by the carrying unit 41*b* is brought into contact with the scale 8 and is then set. In this state, the copying operation is performed. Upon completion of the copying operation, the original D on the original table 2 is carried by the carrying unit 41*b* to an external discharging tray 44 outside the main body 1.

Figure 9A:
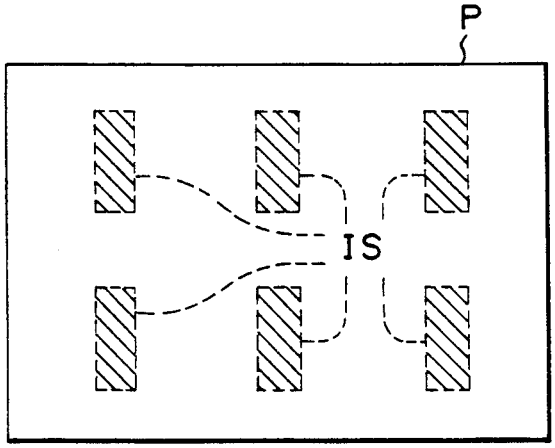
FIG. 9A is a plan view showing an unwanted image IS on a copy sheet in FIG. 8.
Figure 9B:
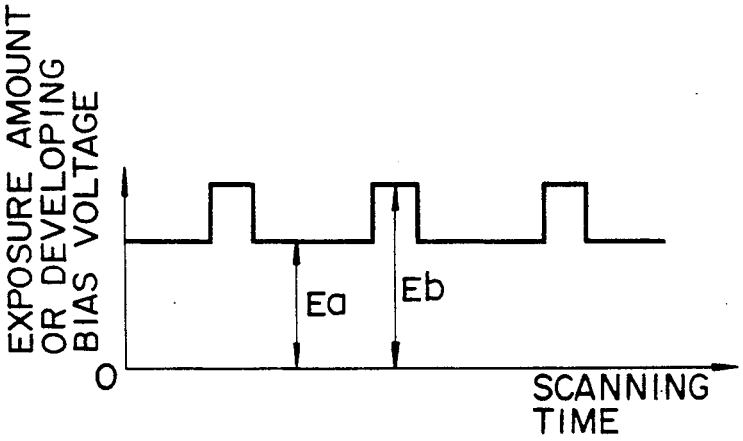
FIG. 9B is a graph explaining a correction value for an exposure amount or a developing bias voltage of the unwanted image IS in FIG. 9A.
Figure 9C:
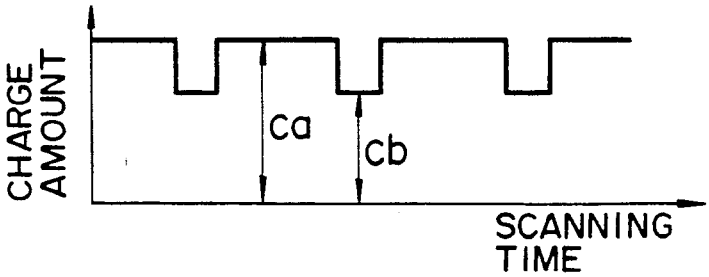
FIG. 9C is a graph explaining a correction value for a charge amount of the unwanted image IS in FIG. 9A.

When a thin original is copied using the automatic original feeder 41, unwanted images IS may be formed in a copied image in correspondence with the carrying rollers 43 mounted in the original table cover 42 and the opening portion 42*a* formed therein, as shown in FIG. 9A. These unwanted images IS can be similarly eliminated as described with reference to the above embodiments. When an exposure amount of the exposure lamp 14*a* or a bias voltage of the developer 17 is changed to eliminate the unwanted images IS, exposure amounts or developing bias voltages may be set in correspondence with the unwanted images IS and may be stored in the memory 32, as shown in FIG. 9B. When a charge amount of the photosensitive drum 15 is changed by the charger 16, a charge amount corresponding to the unwanted images IS may be set and stored in the memory 32, as shown in FIG. 9C.

According to the fourth embodiment of the present invention, even if the plurality of carrying rollers 43 are arranged in the original table cover 42, the unwanted images formed in correspondence with the carrying rollers 43 and the opening portions 42*a* for storing these rollers can be easily eliminated.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. An image forming apparatus comprising:

an original table for supporting an original thereon;

means for covering said original when said covering means is closed, said covering means being incorporated with said original table and having an opening portion which does not cover said original when said covering means is closed;

means for scanning said original to expose an image of said original to a photoconductive member through said original table;

means for forming said image of said original on an image bearing member during one scanning of said scanning means; and means for decreasing a density of said image formed on said image bearing member in accordance with a position of said opening portion of said covering means during one scanning of said scanning means.

2. An apparatus according to claim 1, wherein said decreasing means comprises means for changing an exposure amount of said exposing means in correspondence to said position of said opening portion of said covering means.

3. An apparatus according to claim 1, further comprising means for developing an electrostatic latent image formed on said image bearing member, and wherein said decreasing means comprises means for changing a developing bias voltage of said developing means in correspondence to said second position of said opening portion of said covering means.

4. An apparatus according to claim 1, further comprising charging means for applying an electric charge to said image bearing member, and wherein said decreasing means comprises means for changing a charge amount of said charging means for said image bearing member in correspondence to said position of said opening portion of said covering means.

5. An apparatus according to claim 1, further comprising means for detecting opening/closing of said covering means, and wherein said decreasing means decreases a density of an image formed on a transferred medium in correspondence to said position of said opening portion when said detecting means determines that said covering means is closed.

6. An apparatus according to claim 1, further comprising means, arranged in said opening portion of said covering means, for carrying said original on said original table.

7. An image forming apparatus comprising:

an original table for supporting an original thereon;

means for covering said original when said covering means is closed, said covering means being incorporated with said original table and having an opening portion which does not cover said original when said covering means is closed;

means for decreasing a density of said image formed on a transferred medium in correspondence to a position of said opening portion of said covering means during one scanning of said scanning means;

means for setting an operation mode; and means for changing a correction amount during one scanning of said scanning means when a mode of changing said correction amount is set.

8. An apparatus according to claim 7, wherein said decreasing means comprises means for changing an exposure amount of said exposing means in correspondence to said position of said opening portion of said covering means.

9. An apparatus according to claim 7, further comprising means for developing an electrostatic latent image formed on an image bearing member, and wherein said decreasing means comprises means for changing a developing bias voltage of said developing means in correspondence to said position of said opening portion of said covering means.

10. An apparatus according to claim 7, further comprising charging means for applying an electric charge to an image bearing member, and wherein said decreasing means comprises means for changing a charge amount of said charging means for said image bearing member in correspondence to said position of said opening portion of said covering means.

11. An apparatus according to claim 7, further comprising means for accessing said correction amount changed by said changing means.

12. An apparatus according to claim 7, further comprising means, arranged in said opening portion of said covering means, for carrying said original on said original table.

13. An image forming apparatus comprising:

an original table for supporting an original thereon;

means for covering said original when said covering means is closed, said covering means being incorporated with said original table and having an opening portion which does not cover said original when said covering means is closed;

means for forming an image of said original, said forming means having (1) charging means for applying an electric charge to an image bearing member, (2) means for scanning said original on said original table to expose said original, (3) means for developing an electrostatic latent image formed on an image bearing member, and (4) means for transferring a developed image onto a transferred medium; and means for decreasing a density of said image formed on said transferred medium at a timing corresponding to a position of said opening portion when said image of said original is to be formed on said transferred medium.

14. An apparatus according to claim 10, wherein said decreasing means comprises means for changing an exposure amount of said exposing means in correspondence to said position of said opening portion of said covering means.

15. An apparatus according to claim 13, wherein said decreasing means comprises means for changing a developing bias voltage of said developing means in correspondence to said position of said opening portion of said covering means.

16. An apparatus according to claim 13, wherein said deceasing means comprises means for changing a charge amount of said charging means for said image bearing member in correspondence to said position of said opening portion of said covering means.

17. An apparatus according to claim 13, further comprising means, arranged in said opening portion of said covering means, for carrying said original on said original table.

* * * * *